US007498730B2

(12) United States Patent
Innocenti et al.

(10) Patent No.: US 7,498,730 B2
(45) Date of Patent: Mar. 3, 2009

(54) LIGHT EMITTING DEVICE WITH PHOTONIC CRYSTAL

(75) Inventors: Gianfranco Innocenti, Rivalta (IT); Piero Perlo, Sommariva Bosco (IT); Piermario Repetto, Turin (IT); Denis Bollea, Fiano (IT); Davide Capello, Turin (IT); Stefano Bernard, Orbassano (IT)

(73) Assignee: C.R.F. Societa Consortile per Azioni, Orbassano (Turin) (IT)

( * ) Notice: Subject to any disclaimer, the term of this patent is extended or adjusted under 35 U.S.C. 154(b) by 439 days.

(21) Appl. No.: 11/035,125

(22) Filed: Jan. 13, 2005

(65) Prior Publication Data

US 2005/0168147 A1 Aug. 4, 2005

(30) Foreign Application Priority Data

Jan. 16, 2004 (IT) ..... TO2004A0018

(51) Int. Cl.
*H01K 1/14* (2006.01)
*H01K 9/00* (2006.01)
*H01K 1/18* (2006.01)

(52) U.S. Cl. ..... 313/315; 313/316; 313/273

(58) Field of Classification Search ..... 385/125; 313/315–316, 271–273, 574, 495–497; 362/345; 438/691–692
See application file for complete search history.

(56) References Cited

U.S. PATENT DOCUMENTS

| | | | | |
|---|---|---|---|---|
| 4,807,950 | A | 2/1989 | Glenn et al. | 350/3.61 |
| 5,123,868 | A | 6/1992 | Waymouth | 445/48 |
| 5,152,870 | A | 10/1992 | Levinson | 156/659.1 |
| 5,367,588 | A | 11/1994 | Hill et al. | 385/37 |
| 5,389,853 | A * | 2/1995 | Bigio et al. | 313/341 |
| 5,947,592 | A * | 9/1999 | Barlow | 362/345 |
| 6,404,966 | B1 * | 6/2002 | Kawanishi et al. | 385/125 |
| 6,611,085 | B1 * | 8/2003 | Gee et al. | 313/271 |
| 2002/0145385 | A1 * | 10/2002 | Perlo et al. | 313/522 |
| 2003/0040134 | A1 * | 2/2003 | Deliwala | 438/22 |
| 2003/0071564 | A1 | 4/2003 | Hirayama | 313/501 |

FOREIGN PATENT DOCUMENTS

| | | |
|---|---|---|
| JP | 04-349338 | 12/1992 |
| WO | WO03/058676 A2 | 7/2003 |

OTHER PUBLICATIONS

Hill, Kenneth O and Meltz, Gerald; Fiber Bragg Grating Technology Fundamentals and Overview, Aug. 1997, Journal of Lightwave Technology, vol. 15, No. 8, pp. 1263-1276.*

Yablonovitch, Photonic Crystals: Semiconductors of Light, Scientific American, Dec. 2001, 47-55.*

European Search Report dated Jul. 17, 2007 from the corresponding European Patent Application No. 04030244.0-1226.

* cited by examiner

*Primary Examiner*—Nimeshkumar D. Patel
*Assistant Examiner*—Anne M Hines
(74) *Attorney, Agent, or Firm*—Young Basile

(57) ABSTRACT

A light-emitting device comprises a light source in the form of an incandescent filament, a substantial part of which is integrated in a host element having at least one portion structured according to nanometric dimensions. The nano-structured portion is in the form of a photonic crystal or of a Bragg grating for the purpose of obtaining an amplified or increased emission of radiation in the region of the visible.

24 Claims, 3 Drawing Sheets

LIGHT EMITTING DEVICE WITH PHOTONIC CRYSTAL

SUMMARY OF THE INVENTION

The present invention relates to a light-emitting device comprising a substantially filiform light source that can be activated via passage of electric current.

As is known, in incandescent light bulbs, the electric current traverses a light source constituted by a filament made of tungsten, housed in a glass bulb in which a vacuum has been formed or in which an atmosphere of inert gases is present, and renders said filament incandescent. The emission of electromagnetic radiation thus obtained follows, to a first approximation, the so-called black-body distribution corresponding to the temperature T of the filament (in general, approximately 2700K). The emission of electromagnetic radiation in the region of visible light (380-780 nm), as represented by the curve A in the attached FIG. 1, is just one portion of the total emission curve.

The present invention is mainly aimed at providing a device of the type indicated above that enables a selectivity and above all an amplification of the electromagnetic radiation of the optical region, or of a specific chromatic band, at the expense of the infrared region, as highlighted for example by the curve B of FIG. 1.

The above purpose is achieved, according to the invention, by a light-emitting device having the characteristics specified in the annexed claims, which are to be understood as forming an integral part of the present description.

BRIEF DESCRIPTION OF THE DRAWINGS

Further purposes, characteristics and advantages of the present invention will emerge clearly from the ensuing description and from the annexed drawings, which are provided purely by way of explanatory and non-limiting example and in which.

DETAILED DESCRIPTION OF THE INVENTION

Figure 2:
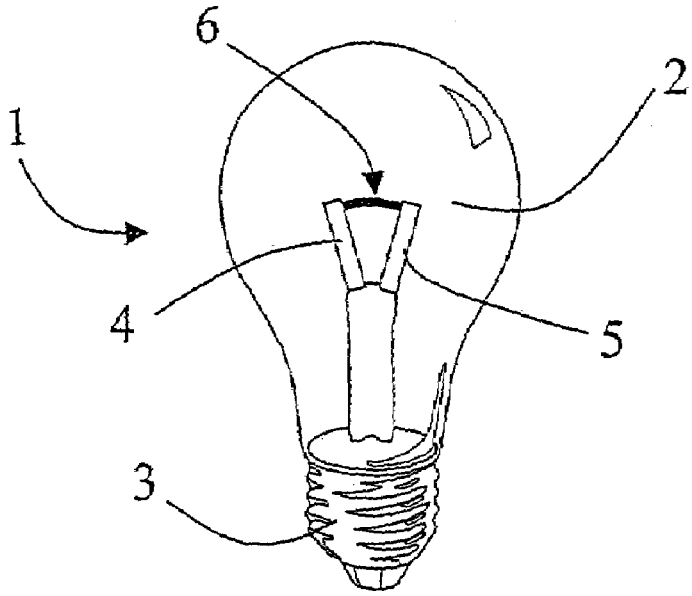
FIG. 2 is a schematic illustration of a generic embodiment of a light-emitting device according to the invention.

FIG. 2 represents a light-emitting device according to the invention. In the case exemplified, the device has the shape of an ordinary light bulb, designated as a whole by 1, but this shape is to be understood herein as being chosen purely by way of example.

According to the known art, the light bulb 1 comprises a glass bulb, designated by 2, which is filled with a mixture of inert gases, or else in which a vacuum is created, and a bulb base, designated by 3. Inside the bulb 2 there are set two electrical contacts, schematically designated by 4 and 5, connected between which is a light source or emitter, designated as a whole by 6, made according to the invention. The contacts 4 and 5 are electrically connected to respective terminals formed in a known way in the bulb base 3. Connection of the bulb base 3 to a respective bulb socket enables connection of the light bulb 1 to the electrical-supply circuit.

Basically, the idea underlying the present invention is that of integrating or englobing a substantially filiform light source, which can be excited or brought electrically to incandescence, in a host element structured according to nanometric or sub-micrometric dimensions in order to obtain a desired spectral selectivity of emission, with an amplification of the radiation emitted in the visible region at the expense of the infrared portion.

The emitter element may be made of a continuous material, for example in the form of a tungsten filament, or else of a cluster of one or more molecules in contact of a semiconductor type, or of a metallic type, or in general of an organic-polymer type with a complex chain or with small molecules.

The host element that englobes the emitter element may be nano-structured via removal of material so as to form micro-cavities, or else via a modulation of its index of refraction as in Bragg gratings. As will emerge in what follows, in this way the light-emitting device proves more efficient since the infrared emission can be inhibited and its energy transferred into the optical region. Furthermore, for this reason the temperature of the light-emitter element is lower than that of traditional light bulbs and light sources.

Figure 3:
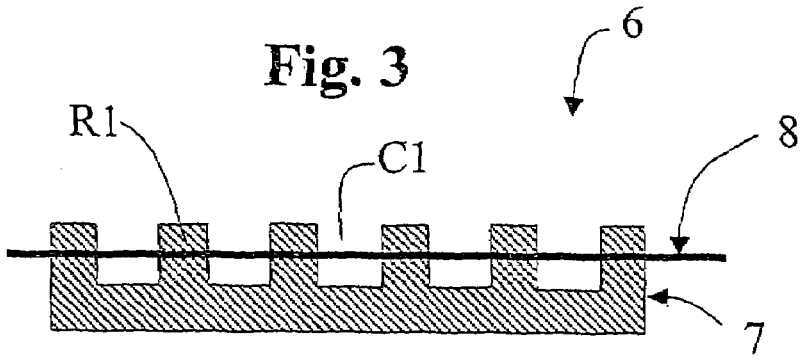
FIGS. 3 and 4 are schematic representations, respectively in a cross-sectional view and in a perspective view, of a portion of a light source obtained in accordance with a first embodiment of the invention, which can be used in the device of FIG. 2.
Figure 4:
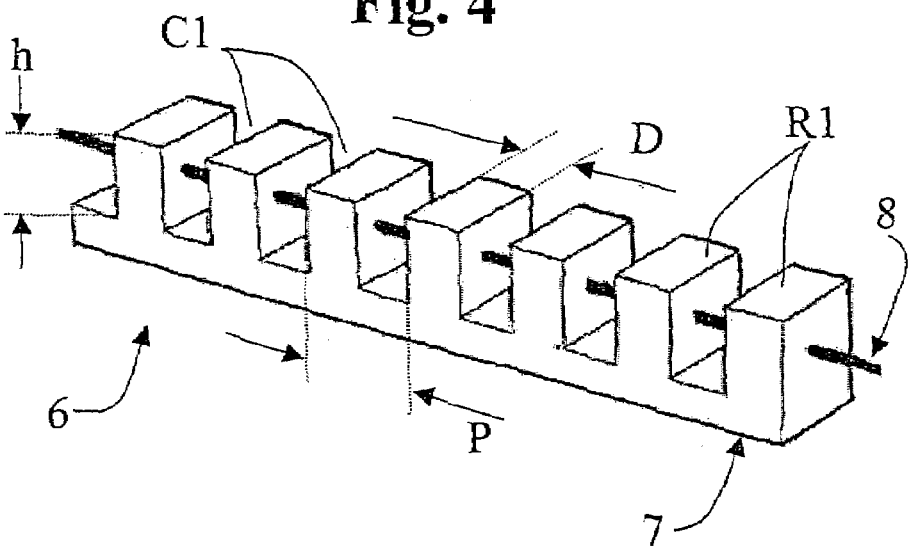

FIGS. 3 and 4 illustrate a portion of a light source or emitter 6 according to the invention, which comprises a host element 7, integrated in which is a filament, designated by 8, which can be brought to incandescence and which may be made, for example, of tungsten or powders of tungsten. The host element 7 is structured according to micrometric or nanometric dimensions, so as to present an orderly and periodic series of micro-cavities C1, intercalated by full portions or projections R1 of the same element.

Integrated in the host element 7 is the filament 8 in such a way that the latter will pass, in the direction of its length, both through the cavities C1 and through the projections R1. With this geometry, coupling between the density of the modes present in the cavity (maximum peak at the centre of the cavity) and the emitter element is optimized (for greater details reference may be made to F. De Martini, M. Marrocco, P. Mataloni, L. Crescentini and R. Loudon, "*Spontaneous emission in the optical microscopic cavity*" in Physical Review A (Atomic, Molecular and Optical Physics), Volume 43, Issue 5, Mar. 1, 1001, pp. 2480-2497).

In the case exemplified in FIGS. 3 and 4, the host element 7 is structured in the form of a one-dimensional photonic crystal, namely, a crystal provided with projections R1 and cavities C1 that are periodic in just one direction on the surface of the element itself. In FIG. 4, designated by h is the depth of the cavities C1 (which corresponds to the height of the projections R1), designated by D is the width of the projections R1, and designated by P is the period of the grating; the filling factor of the grating R is defined as the ratio D/P.

The theory that underlies photonic crystals originates from the works of Yablonovitch and results in the possibility of providing materials with characteristics such as to affect the properties of photons, as likewise semiconductor crystals affect the properties of the electrons.

Yablonovitch demonstrated in 1987 that materials the structures of which present a periodic variation of the index of refraction can modify drastically the nature of the photonic modes within them. This observation has opened up new perspectives in the field of control and manipulation of the properties of transmission and emission of light by matter.

In greater detail, the electrons that move in a semiconductor crystal are affected by a periodic potential generated by the interaction with the nuclei of the atoms that constitute the crystal itself This interaction results in the formation of a series of allowed energy bands, separated by forbidden energy bands (band gaps).

A similar phenomenon occurs in the case of photons in photonic crystals, which are generally constituted by bodies made of transparent dielectric material defining an orderly series of micro-cavities in which there is present air or some other means having an index of refraction very different from that of the host matrix. The contrast between the indices of refraction causes confinement of photons with given wavelengths within the cavities of the photonic crystal. The confinement to which the photons (or the electromagnetic waves) are subject on account of the contrast between the indices of refraction of the porous matrix and of the cavities results in the formation of regions of allowed energies, separated by regions of forbidden energies. The latter are referred to as photonic band gaps (PBGs). From this fact there follow the two fundamental properties of photonic crystals:

i) by controlling the dimensions, the distance between the cavities, and the difference between the refractive indices, it is possible to prevent spontaneous emission and propagation of photons of given wavelengths (by way of exemplifying reference regarding enhancement of spontaneous emission in the visible band in micro-cavities see F. De Martini, G. Innocenti, G. R. Jacobvitz, "*Anomalous Spontaneous Emission Time in a Microscopic Optical Cavity*", Physical Review Letter, Volume 59, No. 26, Dec. 28, 1987, pp. 2955-2958); in particular, the filling factor D/P and the pitch P of the grating determines the position of the photonic band gap; and ii) as in the case of semiconductors, where there are present dopant impurities within the photonic band gap, it is possible to create allowed energy levels.

Basically, according to the invention, the aforesaid properties are exploited to obtain micro-cavities C1, within which the emission of light produced by the filament 8 brought to incandescence is at least in part confined in such a way that the frequencies that cannot propagate as a result of the band gap are reflected. The surfaces of the micro-cavities C1 hence operate as mirrors for the wavelengths belonging to the photonic band gap.

As has been said, by selecting appropriately the values of the parameters that define the properties of the photonic crystal of the host element 7, and in particular the filling factor D/P and the pitch P of the grating, it is possible to prevent, or at least attenuate, propagation of radiation of given wavelengths and enable simultaneously propagation of radiation of other given wavelengths.

In the above perspective, for instance, the grating can be made so as to determine a photonic band gap that will prevent spontaneous emission and propagation of infrared radiation, and at the same time enable the peak of emission in a desired area in the 380-780-nm range to be obtained in order to produce, for instance, a light visible as blue, green, red, etc.

The host element 7 can be made using any transparent material suitable for being surface nano-structured and for withstanding the temperatures developed by the incandescence of the filament 8. The techniques of production of the emitter element 6 provided with periodic structure of micro-cavities C1 may be based upon nano- and micro-lithography, nano- and micro-photolithography, anodic electrochemical processes, chemical etching, etc., i.e., techniques already known in the production of photonic crystals (alumina, silicon, and so on).

Alternatively, the desired effect of selective and amplified emission of optical radiation can be obtained also via a modulation of the index of refraction of the optical part that englobes the emitter element, i.e., by structuring the host element 7 with a modulation of the index of refraction typical of fibre Bragg gratings (FBGs), the conformations and corresponding principle of operation of which are well known to a person skilled in the art.

Figure 5:
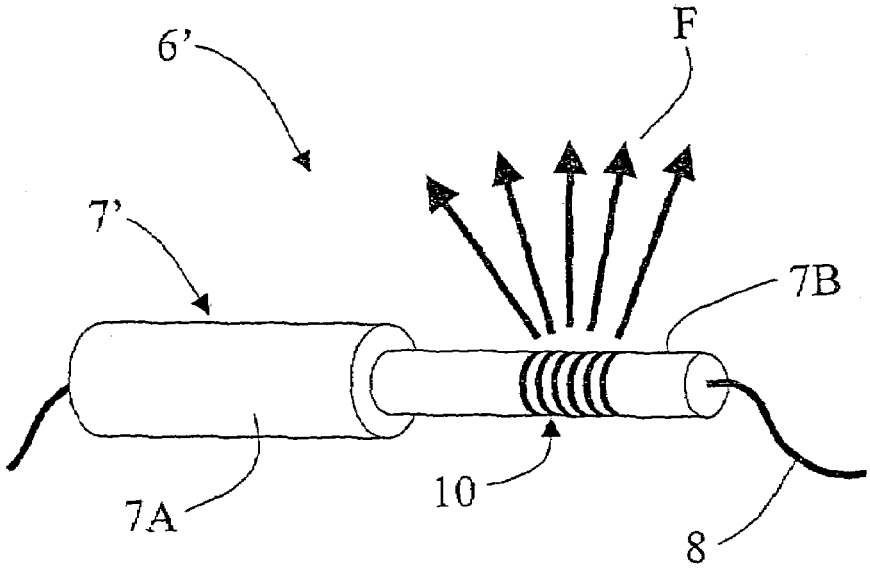
FIG. 5 is a partial and schematic perspective view of a portion of a light source obtained according to a second embodiment of the invention.

For the above purpose, FIG. 5 is a schematic representation, by way of non-limiting example, of an emitter, designated by 6', which comprises a tungsten filament 8 integrated in a doped optical fibre (for example doped with germanium), designated as a whole by 7', which has a respective cladding, designated by 7A, and a core 7B, within which the filament 8 is integrated. In at least one area of the surface of the core 7B there are inscribed Bragg gratings, designated, as a whole, by 10 and represented graphically as a series of light bands and black bands, designed to determine a selective and amplified emission of a desired radiation, represented by the arrows F.

The grating or gratings 10 can be obtained via ablation of the dopant molecules present in the host optical element 7 with modalities in themselves known, for example using imprinting techniques of the type described in the documents U.S. Pat. Nos. 4,807,950 and 5,367,588, the teachings of which in this regard are incorporated herein for reference.

Figure 1:
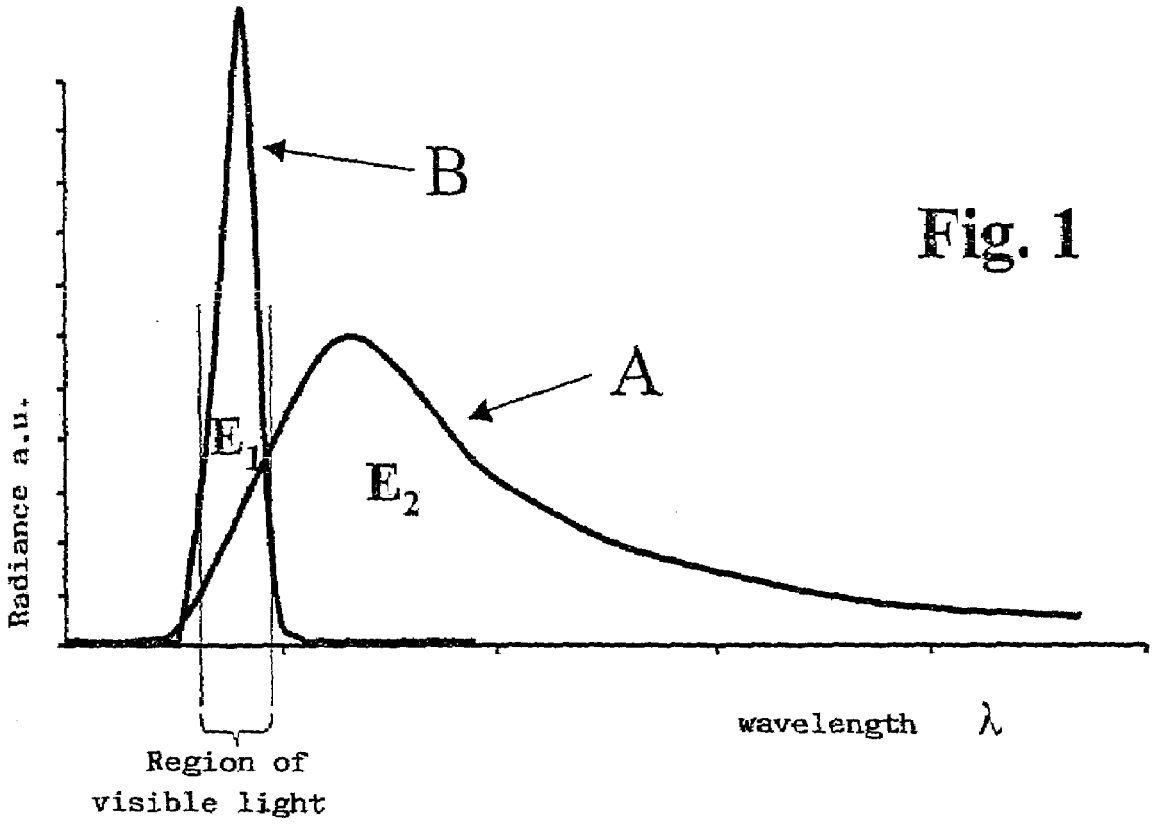
FIG. 1 is a graph which represents the spectral emission obtained by an ordinary tungsten filament (curve A) and the spectral emission of a light source according to the invention (curve B)

From the graph of FIG. 1 it may be noted how the curve designated by A, representing the spectrum of emission obtained by a normal tungsten filament, has a trend according to a curve of the black-body type. In the case of the invention, in which the filament is integrated in an optical fibre with Bragg gratings, as represented by the embodiment of FIG. 5, the energy spectral density represented by the curve B presents, instead, a peak located in a spectral band depending upon the geometrical conditions of the gratings 10. The areas under each curve A and B, designated respectively by $E_2$ and $E_1$, represent the emitted energy, which remains the same in the two cases (i.e., $E_1=E_2$).

Modulation can hence be obtained both via a sequence of alternated empty spaces and full spaces and via a continuous structure (made of one and the same material) with different indices of refraction obtained by ablation of some molecules from the material of the host element.

Of course, for the purposes of practical use of the emitter 6, 6' of FIGS. 3-5, the two ends of the element 8 will be connected to appropriate electrical terminals for application of a potential difference. In the case of the device exemplified in FIG. 2, then, the filament 8 is electrically connected to the contacts 4 and 5.

Practical tests conducted have made it possible to conclude that the device according to the invention enables the desired chromatic selectivity of the light emission to be obtained and, above all, its amplification in the visible region. The most efficient results, in the case of the embodiment represented in FIGS. 3, 4, is obtained by causing the filament 8 to extend through approximately half of the depth of the cavities C1. With this geometry, coupling between the density of the modes present in the cavity (maximum peak at the centre of the cavity) and the emitting element is optimized.

From the foregoing description, the characteristics and advantages of the invention emerge clearly. As has been explained, the invention enables amplification of radiation emitted in the visible region at the expense of the infrared portion, via the construction of elements 6, 6' that englobe the filament 8 and that are nano-structured through removal of material, as in FIGS. 3-4, or else through modulation of the index of refraction, as in FIG. 5. The device thus obtained is more efficient, in so far as the infrared emission is inhibited, and its energy is transferred into the visible range, as is evident from FIG. 1. For this reason, moreover, the temperature of the filament 8 is lower than that of traditional light bulbs.

The accuracy with which the aforesaid nanometric structures can be obtained gives rise to a further property, namely, chromatic selectivity. In the visible region there can then further be selected the emission lines, once again exploiting the principle used for eliminating the infrared radiation, for example to provide monochromatic sources of the LED type.

The emitter 6, 6' may be obtained in the desired length and, obviously, may be used in devices other than light bulbs. In this perspective, it is emphasized, for example, that emitters structured according to the invention may advantageously be used for the formation of pixels with the R, G and B components of luminescent devices or displays.

It is also emphasized that the emitters structured according to the invention are, like optical fibres, characterized by a considerable flexibility, so that they can be arranged as desired to form complex patterns. In the case of embedding of the incandescent filament in an optical fibre, in the core of the latter there may be formed a number of Bragg gratings, each organized so as to obtain a desired light emission.

Of course, without prejudice to the principle of the invention, the details of construction and the embodiments may vary widely with respect to what is described and illustrated herein purely by way of example, without thereby departing from the scope of the present invention.

In the case exemplified previously, the photonic-crystal structure defined in the host element 7 is of the one-dimensional type, but it is clear that in possible variant embodiments of the invention the grating may have more dimensions, for example be two-dimensional, i.e., with periodic cavities/projections in two orthogonal directions on the surface of the element 7.

Figure 6:
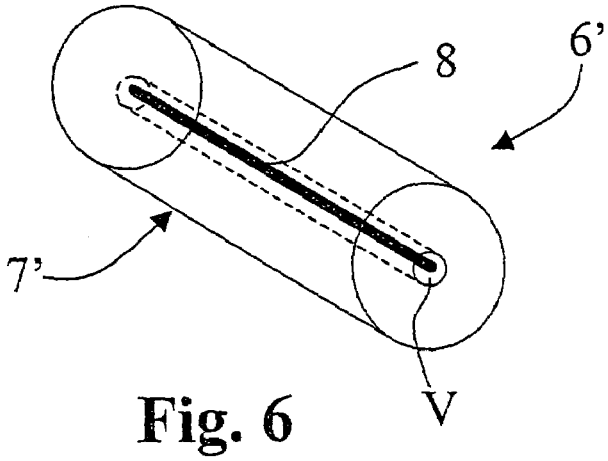
FIGS. 6 and 7 are schematic representations, respectively in a perspective view and in a cross-sectional view, of a light source obtained according to a third embodiment of the invention.
Figure 7:
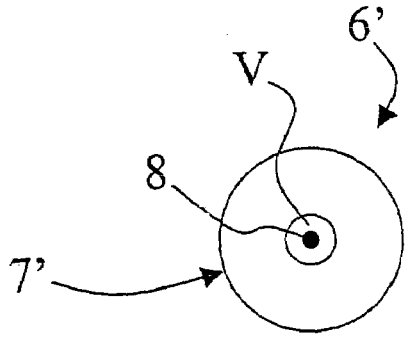

As exemplified previously, the electrically-excited source 8 may be made in full filiform forms, integrated in a structure 7 of the photonic-crystal type or in a nano-structured cylindrical fibre 7', which has a passage having a diameter equal to the diameter of the filiform source, as represented in FIG. 5. In a possible variant, illustrated in FIGS. 6 and 7, in the fibre 7' there can be defined an empty passage or space V, having an inner diameter greater than the diameter of the filiform source 8, the space not occupied by the source being filled with mixtures of inert gases.

In other embodiments, the light sources 8 can be constituted by concatenated cluster composites of an inorganic or organic type, or of a hybrid inorganic and organic type, which are set within the fibre 7'.

Figure 8:
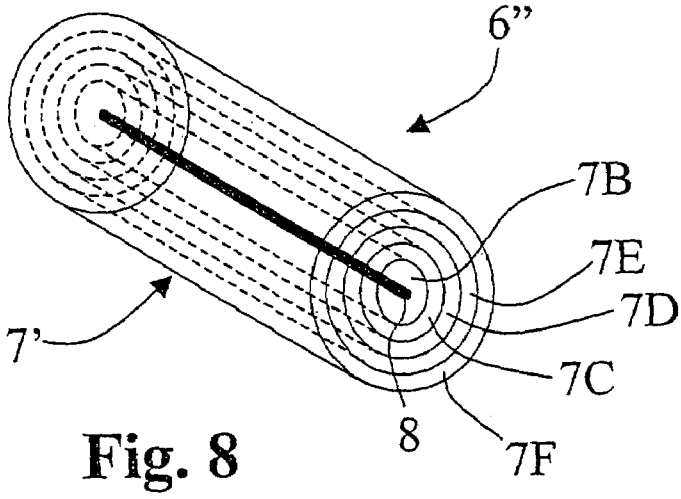
FIGS. 8 and 9 are schematic representations, respectively in a perspective view and in a cross-sectional view, of a light source obtained according to a fourth embodiment of the invention.
Figure 9:
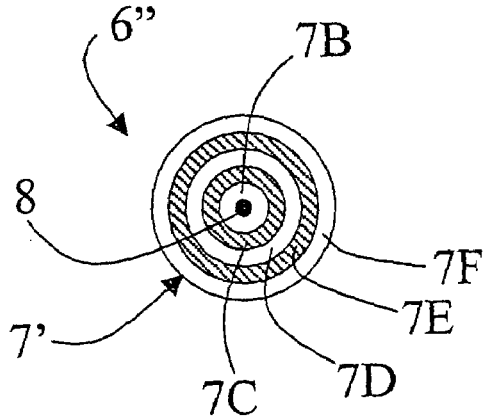

According to a further variant, exemplified in FIGS. 8 and 9, the emitter, designated by 6", can comprise a source 8 set either inside a full core 7B or, in the case of a source having a cylindrical shape, on said core. The core 7B is then coated by one or more cylindrical layers 7C, 7D, 7E, 7F, . . . $7_n$ made of materials having different compositions and indices of refraction to form the host element here designated by 7". Specific fabrications may envisage a number of levels of material. In this sense, proceeding from the center to the outermost diameter, there may be identified two or more materials with different indices of refraction and, in particular, arranged as a semiconductor heterostructure, which will facilitate the energetic jumps for light emission. The outermost layers will be made of transparent material, and the difference between the diameter of the core 7B and the diameter of the outermost layer 7F will be such as to confine the light emission between the jumps of the structure or semiconductor heterostructure.

In some configurations, the electric current may be applied in the axis of the filiform source and the emission of light will be confined by the dimension and by the nanometric structure of the fibre that contains the source itself In other configurations, the current can be applied transversely between two layers set between the core and the outermost diameter.

What is claimed is:

1. A light-emitting device comprising a substantially filiform light source capable of being activated via passage of electric current for the purposes of emission of electromagnetic waves, wherein:

at least one filiform source extends through a host element longitudinally extended; and wherein at least part of the host element includes a nano-structure configured to increase emission, from the host element, of electromagnetic waves having wavelengths in a range of 380 to 780 nm and to prevent spontaneous emission and propagation, from the host element, of infrared radiation, the nano-structure comprising a periodic series of cavities having nanometric dimensions and each filiform source extending through a plurality of the cavities of the periodic series; and wherein said part of the host element is structured in the form of a photonic crystal configured to obtain a photonic band gap that prevents said spontaneous emission and propagation of infrared radiation and increases said emission of electromagnetic waves having wavelengths in said range of 380 to 780 nm.

2. The device according to claim 1, wherein said filiform source is formed at least in part by a continuous material.

3. The device according to claim 2, wherein said filiform source is formed of tungsten.

4. The device according to claim 1, wherein said filiform source comprises a filament capable of incandescence.

5. A light-emitting device, comprising:

a filiform light source capable of being activated via passage of electric current for the purposes of emission of electromagnetic waves; and a host element having a longitudinally-extending body including a nano-structure adapted to:

increase emission of electromagnetic waves having wavelengths in a visible range; and prevent emission of electromagnetic waves having wavelengths in an infrared range, the nano-structure including a succession of projections of said body, said projections being aligned and spaced apart with each other in a longitudinal direction of said body to define an orderly and periodic series of cavities having nanometric dimensions, each of said cavities being defined between two successive projections of said succession; wherein the light source has a length and at least a part thereof extending in a length direction both through said cavities and through said projections of the nano-structure;

wherein the body of the host element has a base portion spaced apart from the light source;

wherein the base portion extends in a length direction of the light source;

wherein said projections rise from said base portion such that each of said cavities has a respective bottom surface defined by said base portion; and wherein said nano-structure of the host element is in the form of a photonic crystal periodic in one dimension.

6. The device according to claim 5, wherein said cavities have a depth; and wherein the light source traverses the cavities at an intermediate region of the depth at a distance from said bottom surface.

7. The device according to claim 6, wherein said projections have a height; and wherein the light source traverses the projections at an intermediate region of the height.

8. The device according to claim 6, wherein a portion of said filiform source that traverses the projections of said succession extends to approximately half of the height of the projections.

9. The device according to claim 5, wherein said light source is formed by a single wire made of tungsten.

10. The device according to claim 5, wherein said light source comprises an incandescence filament.

11. The device according to claim 5, wherein said body of the host element comprises a transparent material.

12. A light-emitting device comprising a substantially filiform light source capable of being activated via passage of electric current for the purposes of emission of electromagnetic waves, wherein:

at least one filiform source extends through a host element longitudinally extended; wherein at least part of the host element includes a nano-structure configured to increase emission, from the host element, of electromagnetic waves having wavelengths in a range of 380 to 780 nm and to prevent spontaneous emission and propagation, from the host element, of infrared radiation, the nano-structure comprising a periodic series of cavities having nanometric dimensions and each filiform source extending through a plurality of the cavities of the periodic series; wherein the host element has a longitudinally-extending body including:

a base portion spaced apart from said light source and extending in a length direction of the light source; and a succession of projections rising from said base portion, said projections aligned and spaced apart with each other in a longitudinal direction of said base portion to define said periodic series of cavities, each of said cavities being defined between two successive projections of said succession and having a respective bottom surface defined by said base portion;

wherein said light source extends, in the length direction thereof, both through said cavities and through said projections of the nano-structure;

wherein the host element is in the form of a photonic crystal, said projections and said cavities being periodic in a length direction of the base portion to form a grating having a pitch;

the projections have a height and a width;

the grating has a filling factor defined by the ratio of the width of the projections to the pitch of the grating; and wherein said filling factor and said pitch are selected to obtain a photonic band gap that prevents said spontaneous emission and propagation of infrared radiation and increases said emission of electromagnetic waves having wavelengths in said range of 380 to 780 nm.

13. The device according to claim 12, wherein the cavities have a depth and a portion of said filiform source that traverses the cavities of said periodic series extends to approximately half of the depth of the cavities, at a distance from bottom surfaces thereof.

14. The device according to claim 13, wherein a portion of said filiform source that traverses the projections of said succession extends to approximately half of the height of the latter.

15. The device according to claim 13, wherein said filiform source comprises a filament capable of incandescence.

16. The device according to claim 12, wherein portions of said filiform source traverse the plurality of cavities of the periodic series at a uniform depth.

17. The device according to claim 16, wherein the uniform depth is half of the depth of a respective cavity.

18. The device according to claim 12, wherein said part of the host element is structured in the form of a photonic crystal configured to obtain a photonic band gap that prevents said spontaneous emission and propagation of infrared radiation and increases said emission of electromagnetic waves having wavelengths in said range of 380 to 780 nm.

19. The device according to claim 12, wherein said filling factor and said pitch are selected to enable a peak of emission of electromagnetic waves in a given area of said range of 380 to 780 nm.

20. The device according to claim 19, wherein said given area of said range of 380 to 780 nm is selected to cause emission of light visible as blue.

21. The device according to claim 19, wherein said given area of said range of 380 to 780 nm is selected to cause emission of light visible as red.

22. The device according to claim 19, wherein said given area of said range of 380 to 780 nm is selected to cause emission of light visible as green.

23. A light-emitting device comprising a substantially filiform light source capable of being activated via passage of electric current for the purposes of emission of electromagnetic waves, wherein:

at least one filiform source extends through a host element longitudinally extended; wherein at least part of the host element includes a nano-structure configured to increase emission, from the host element, of electromagnetic waves having wavelengths in a range of 380 to 780 nm and to prevent spontaneous emission and propagation, from the host element, of infrared radiation, the nano-structure comprising a periodic series of cavities having nanometric dimensions and each filiform source extending through a plurality of the cavities of the periodic series; and wherein said part of the host element is structured in the form of a photonic crystal configured to enable a peak of emission of electromagnetic waves in a given area of said range of 380 to 780 nm.

24. The device according to claim 23, wherein said given area of said range of 380 to 780 nm is selected to obtain emission of one of a blue visible light, a red visible light, a green visible light.

* * * * *